US008973168B2

(12) United States Patent
Amburgey

(10) Patent No.: US 8,973,168 B2
(45) Date of Patent: Mar. 10, 2015

(54) ATHLETIC PANTS

(76) Inventor: Travis Amburgey, Grass Lake, MI (US)

( * ) Notice: Subject to any disclaimer, the term of this patent is extended or adjusted under 35 U.S.C. 154(b) by 0 days.

(21) Appl. No.: 14/126,175

(22) PCT Filed: Jun. 18, 2012

(86) PCT No.: PCT/US2012/042936

§ 371 (c)(1),
(2), (4) Date: Dec. 13, 2013

(87) PCT Pub. No.: WO2012/174523

PCT Pub. Date: Dec. 20, 2012

(65) Prior Publication Data

US 2014/0115753 A1 May 1, 2014

Related U.S. Application Data

(60) Provisional application No. 61/498,171, filed on Jun. 17, 2011.

(51) Int. Cl.

| | |
|---|---|
| ***A41D 1/08*** | (2006.01) |
| ***A41D 13/05*** | (2006.01) |
| ***A41B 11/00*** | (2006.01) |
| ***A41D 15/00*** | (2006.01) |

(52) U.S. Cl.

CPC ..... *A41D 13/0543* (2013.01); *A41B 11/00* (2013.01); *A41D 1/08* (2013.01); *A41D 15/002* (2013.01); *A41D 2400/38* (2013.01)

USPC ..... 2/227

(58) Field of Classification Search

USPC ..... 2/22, 23, 24, 227, 232, 269, 270, 456, 2/457, 79, 401, 404, 407, 228, 233, 238, 2/242, 82, 901, 231

See application file for complete search history.

(56) References Cited

U.S. PATENT DOCUMENTS

| | | | | | |
|---|---|---|---|---|---|
| 189,883 | A | * | 4/1877 | Thompson | 2/227 |
| 653,157 | A | * | 7/1900 | Turner | 2/227 |
| 1,143,282 | A | * | 6/1915 | King | 2/83 |
| 1,652,750 | A | * | 12/1927 | Wohlgemuth | 2/227 |
| 2,216,852 | A | * | 10/1940 | McMeekin | 2/270 |
| 2,274,270 | A | * | 2/1942 | Kalb | 2/227 |
| 3,496,572 | A | * | 2/1970 | Herzig | 2/457 |
| 3,670,339 | A | * | 6/1972 | Cooper et al. | 2/22 |
| 3,671,975 | A | * | 6/1972 | Vorsteher | 2/232 |
| 3,787,892 | A | | 1/1974 | Quinn | |

(Continued)

OTHER PUBLICATIONS

International Search Report of PCT/US2012/042936, Mailed on Jan. 21, 2013, 3 pages.

*Primary Examiner* — Amy Vanatta
(74) *Attorney, Agent, or Firm* — Brinks Gilson & Lione

(57) ABSTRACT

Athletic pants including a compression garment made of a stretchable fabric configured to substantially conform to the contours of a person wearing the compression garment. The compression garment includes a hollow torso section having an opening at its upper end and a pair of hollow legs extending in a direction away from the opening and terminating in a cuff. Cover portions are disposed over and surround at least a portion of each leg. Each of the cover portions having attached and free ends, with the cover portions being attached at their attached ends to the compression garment and otherwise being unattached to the compression garment such that the free ends are selectively positionable respectively along the length of the leg over which the cover portion is disposed.

21 Claims, 2 Drawing Sheets

(56) References Cited

U.S. PATENT DOCUMENTS

| | | | | | |
|---|---|---|---|---|---|
| 4,035,844 | A | | 7/1977 | Atack et al. | |
| 4,089,064 | A | | 5/1978 | Chandler, Jr. | |
| 4,091,466 | A | | 5/1978 | Kearn | |
| 4,811,427 | A | | 3/1989 | Regan | |
| 4,894,867 | A | * | 1/1990 | Ceravolo et al. | 2/238 |
| 5,070,544 | A | * | 12/1991 | Aliberti et al. | 2/170 |
| 5,105,473 | A | * | 4/1992 | Valtakari | 2/461 |
| 5,539,927 | A | | 7/1996 | Holubec | |
| 5,598,586 | A | * | 2/1997 | Munjone | 2/237 |
| D418,966 | S | | 1/2000 | Walsh | |
| 6,070,273 | A | * | 6/2000 | Sgro | 2/455 |
| 6,141,802 | A | * | 11/2000 | Drake | 2/227 |
| 6,782,559 | B2 | | 8/2004 | Regan | |
| 7,181,774 | B2 | * | 2/2007 | Silver | 2/227 |
| 7,216,371 | B2 | | 5/2007 | Wong | |
| 7,389,547 | B1 | * | 6/2008 | Wiens | 2/227 |
| 7,694,349 | B2 | * | 4/2010 | Skottheim | 2/69 |
| 7,716,755 | B1 | | 5/2010 | Wiens | |
| 7,937,767 | B2 | | 5/2011 | Leach et al. | |
| 8,316,468 | B2 | * | 11/2012 | Skottheim et al. | 2/227 |
| 8,752,212 | B2 | * | 6/2014 | Byrnes | 2/16 |
| 2002/0138893 | A1 | | 10/2002 | Culhane | |
| 2006/0185063 | A1 | | 8/2006 | Hoffman | |
| 2006/0282938 | A1 | * | 12/2006 | Jewell et al. | 2/227 |
| 2007/0016996 | A1 | | 1/2007 | Seitzinger et al. | |
| 2007/0234467 | A1 | | 10/2007 | Leach et al. | |
| 2009/0013442 | A1 | | 1/2009 | Matuszak | |
| 2009/0172859 | A1 | | 7/2009 | Clement | |
| 2009/0271916 | A1 | | 11/2009 | Harris | |
| 2010/0043123 | A1 | | 2/2010 | Goodhand et al. | |
| 2011/0016602 | A1 | | 1/2011 | Berns et al. | |
| 2011/0179552 | A1 | * | 7/2011 | Bickley et al. | 2/227 |
| 2011/0265250 | A1 | | 11/2011 | Jewell et al. | |
| 2012/0180181 | A1 | * | 7/2012 | Best et al. | 2/16 |

* cited by examiner

ATHLETIC PANTS

CROSS REFERENCES TO RELATED APPLICATION

This application claims priority to provisional application No. 61/498,171 filed on Jun. 17, 2011, the entire contents of which are hereby incorporated by reference.

BACKGROUND

1. Field of the Invention

The present invention generally relates to athletic apparel. More specifically, the invention relates to athletic pants incorporating features to retain protective equipment in position relative to the wearer of the pants.

2. Description of Related Art

Typically, a sport participant requires several pieces of gear to be adequately prepared and protected for participation in an athletic event. For example, a hockey player requires equipment and apparel that includes not only protective equipment, but also pants, a base layer and socks/stockings. For a male player, an athletic supporter and an athletic cup are also required. For a male player, the athletic supporter is donned the first and the athletic cup is positioned within the supporter. Next, the base layer, which may be compression shorts or tights, is applied over the athletic supporter and cup. Alternatively, the athletic supporter and cup maybe donned after the base layer. Next, protective gear in the form of shin and knee guards are positioned on the legs of the player, over the compression tights if they are being worn. Hockey socks are then put on and pulled up over the shin and knee guards. Tape, of the same color as the hockey socks, is often wrapped around the outside of the hockey socks to secure the shin and knee guards and retained them in position on the player over the course of the game or practice. The hockey pants are then put on. Prior to donning the hockey pants, a fastening mechanism, such as Velcro or a garter, is used to secure to the top of the hockey socks and prevent them falling down. If Velcro is used, it is employed with a compatible hockey jock/short. Once the lower body of the player is equipped, additional equipment is then put on to cover and protect the upper body of the player.

As seen from the above, hockey, and many other sporting activities, our gear intensive. This requires the player, or with younger players the parent, to keep track of a large amount of gear when proceeding to practice or a game. Additionally, it requires that any separate pieces of gear, apparel in particular, must be accounted for after the washing of the apparel. When this washing is done en mass for a team, it requires the equipment manager of the team to account for many separate pieces of apparel for each individual player. Furthermore, when Velcro is used as the means for securing the hockey socks to the hockey pants, apparel may become inadvertently stuck in other pieces of apparel of other players.

In addition to the burden required to keep track of and maintain the equipment and apparel, the sheer volume of the gear makes suiting up for practice or game a burdensome task. During the practice or game, the weight imparted by this volume of gear eventually imparts fatigue to the player.

The above applies not only to hockey, but also many other sports. Sports such as football, lacrosse and motocross are all gear intensive. Many other sports, such as soccer, also required gear, even though the gear requirement may be less than those mentioned above.

SUMMARY

In view of the above, the present invention provides athletic pants having a pair of hollow legs extending from a hollow midsection to a distal end; a protective pocket disposed in the hollow midsection extending from an apex of the midsection to an upper waistline and defining an opening at the upper waistline; and a cover portion disposed over and surrounding at least a portion of each leg at an attachment point below the apex, the cover portion configured to be selectively positionable along the respective leg between the attachment point and the distal end.

In another aspect of the invention, athletic pants are provided that comprise a body portion configured to be worn about at least part of the lower torso and legs of a person's body, the body portion including a torso section and a pair of leg sections, the leg sections having an upper end integrally formed with and extending downward from the torso section, the leg sections further including a lower end terminating in an opening through which a person's foot can be extended; and a pair of sock portions, each sock portion extending over at least part of one of the leg sections, the sock portions being non-removably attached to the body portion at a first end of the sock portions, a second end of the sock portions being unattached to the body portion, whereby the second end of the sock portion is moveable relative to the leg section to position the sock portion relative to the leg portion.

In a further aspect of the invention, the sock portions form a sleeve about the leg sections.

In an additional aspect of the invention, the sock portions are located exteriorly of the leg sections.

In another aspect of the invention, the legs includes a lateral side and a medial side, a portion of the first end of the sock portion being offset at the medial side relative to a remainder of the first end.

In yet a further aspect of the invention, the portion of the first end defines an offset in a direction toward the second end.

In another aspect of the invention, the offset has a generally U-shaped configuration.

In still another aspect of the invention, the sock portion is free and unconnected to the body portion other than at the first end.

In an additional aspect of the invention, the sock portion is only attached to the leg portion at the first end.

In another aspect of the invention, the sock portion is only attached to the leg portion in a vicinity generally adjacent to the torso section.

In a further aspect of the invention, a protective pocket located within the torso portion.

In still a further aspect of the invention, the protective pocket is generally located between the leg portions In another aspect of the invention, athletic pants are provided comprising: a compression garment made of a stretchable fabric configured to substantially conform to the contours of a person wearing the compression garment, the compression garment including a hollow torso section, the torso section having at its upper end a portion defining an opening and having at its lower end portions defining a pair of hollow legs extending in a direction away from the opening and terminating in an opening through which the person's foot may be extended; and cover portions disposed over and surrounding at least a portion of each leg, each of the cover portions having attached and free ends, the cover portions being attached at their attached ends to the compression garment and otherwise being unattached to the compression garment such that the free ends of the cover portions are selectively positionable respectively along the length of the leg over which the cover portion is disposed.

In another aspect of the invention, the cover portion is formed of a stretchable fabric.

In a further aspect of the invention, the stretchable fabric of the cover portion is the same as the stretchable fabric of the compression garment.

In an additional aspect of the invention, each of the legs includes a lateral side and a medial side, the first ends of the cover portions being attached to the compression garment with an offset toward the medial side of the legs.

In still another aspect of the invention, the offsets extend in a direction toward the openings of the legs.

In yet a further aspect of the invention, the offsets are formed by seams attaching the cover portions to the compression garment, the seams of the offsets being located a distance to the free ends of the cover portion that is less than a distance from other portions of the seam to the fee ends of the cover portion.

In an additional aspect of the invention, the offsets are formed by seams attaching the cover portions to the compression garment, the seams of the offsets forming a generally U-shaped loop extending in a direction toward the free ends of the cover portions.

In yet another aspect of the invention, the free ends of the cover portions terminate in elastic portions constricting openings defined by the free ends.

In still a further aspect of the invention, the opening at the upper end of the torso section is a waist opening.

In an additional aspect of the invention, a protective pocket is formed within the torso section, the protective pocket being centrally located on the torso section generally between the legs.

Further objects, features and advantages of this invention will become readily apparent to persons skilled in the art after a review of the following description, with reference to the drawings and claims that are appended to and form a part of this specification.

DETAILED DESCRIPTION

Figure 1:
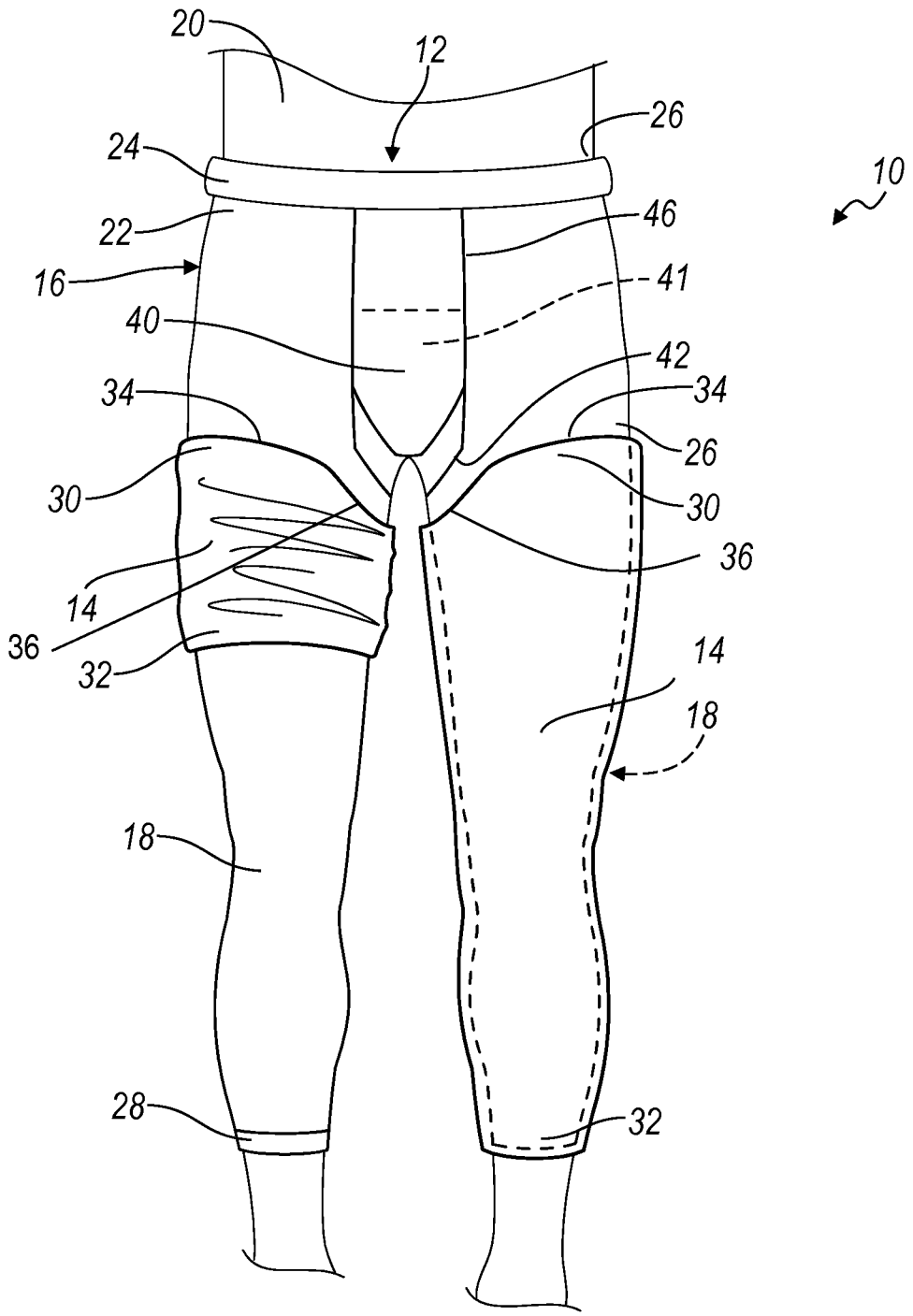
FIG. 1 is an anterior view of athletic pants embodying the principles of the present invention.

Referring now to the drawings, athletic pants embodying the principles of the present invention are illustrated therein and designated at 10. While referred to herein as being athletic pants, is to be understood that the term pants is to be broadly interpreted so as to cover garments having portions covering at least part of the legs of the wearer of the garment. As such, the term would encompass bodysuits, tights and base layers with leg portions of various lengths. Regarding the length of the leg portions, the leg portions may be of various lengths and may extend generally to the vicinity of the ankle the wearer or a location farther above the ankle of the wearer, such as above or below the knee of the wearer.

As seen in FIG. 1, the athletic pants 10 generally include a body portion or compression garment 12 and a pair of cover portions 14. The compression garment 12 itself includes a mid-section or torso section 16 from which extends a pair of leg sections 18. The leg sections 18 are generally provided beneath the cover portions 14 such that the cover portions 14 substantially overlie the length of the leg sections 18, generally in the form of a sleeve thereover.

The torso section 16 is generally hollow and, in the illustrated embodiment, is intended to cover the lowered torso 20 of the person wearing the athletic pants 10. As noted above, in an alternative embodiment, the torso section 16 could extend to also cover the upper torso of the person wearing the athletic pants 10. In the illustrated embodiment, at its upper end 22, the torso section 16 includes a band 24 defining a waist opening 26. At its lower end 26, the previously mentioned leg sections 18 extend from the torso section 16 in a direction away from the band 24 and waist opening 26. Preferably, the torso section 16 and leg sections 18 are unitarily formed such that no seam defines a line of demarcation between these two sections of the athletic pants 10.

The leg sections 18, which are similarly hollow, extend from the torso section 16 until terminating in a cuff 28 or stirrup. The distal end of the leg sections 18 thus form an opening 30 through which the foot of the wearer may be inserted.

The compression garment 12 is constructed of a stretchable fabric material that is, as seen in FIG. 1, configured to generally conform to the contours of the person wearing the garment 12. The cover portions 14 are preferably constructed of the same stretchable fabric material as the compression garment 12. However, the cover portions 14 may be constructed of a different material from that of the compression garment 12.

The cover portions 14 are generally hollow, sleeve-like components that include an attached end 30 and a free end 32. The attached ends 30 are attached to the compression garment 12 generally in the vicinity of where the leg sections 18 extend from the torso section 16. In attaching the cover portions 14 to the leg sections 18, a seam 34 is formed that generally extends around the leg sections 18. In an alternative embodiment, the attached ends 30 are attached to the compression garment 12 in the vicinity of the lower ends of the leg sections 18, generally adjacent to the openings through which the person's foot is passed. This alternative embodiment may find particular application and use by soccer players.

The exact position of the seam 34 in relation to the compression garment 12 may vary. In the illustrated embodiments, the seam 34 is generally located in the upper extent of the leg sections 18. Additionally, the seam 34 is provided with an offset 36. The offset 36 is a portion of the seam 34 forming a bend in the direction traversed by the seam 34; the bend extending in a direction toward the free end 32 of the cover portions and generally forming a U-shaped configuration. By providing the offset 36 to the seam 34, the bulk of material located between the upper thighs of the person wearing the athletic pants 10 is reduced, thereby providing the person with greater comfort and with a less restrictive freedom of movement.

Figure 2:
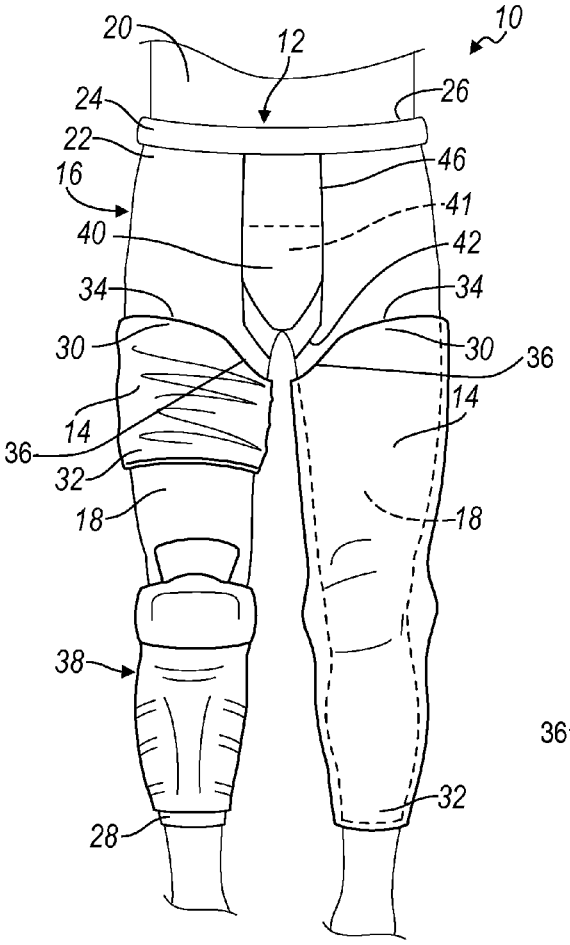
FIG. 2 is an anterior view of the athletic pants seen in FIG. 1 with protective gear being donned by the wearer and shown exposed on one leg and covered on the other leg.

As inferred from the figures, the cover portions 14 are disposed over the length of the leg sections 18 such that the free end 32 of the cover portions 14 may be selectively positioned along the length of the leg sections 18. In the figures, the cover portion 14 on the illustrated right leg has been pulled and gathered upward such that the free end 32 is located at about mid-thigh of the person wearing the pants 10. In this position, the person is enabled to don protective equipment 38 over portions of their legs while wearing the pants 10. As seen in FIG. 2, the protective equipment 38 may include a knee guard and/or a shin guard. With the present invention, the protective equipment 38 is positioned on the wearer over the leg sections 18 of the compression garment 12.

Once the protective equipment 38 has been positioned on the wearer's legs, the cover portions 14 are extended downward and over the protective equipment 38. The cover portions 14 are sized relative to the leg sections 18 and the protective equipment 38 such that the cover portions 14 are tightly fitted over the protective equipment 38. This is perhaps best seen in FIG. 2 on the left leg of the wearer. By sizing the cover portion 14 such that it tightly fits over the protective equipment 38, the cover portion 14 eliminates the need for utilizing tape or other means to secure the protective equipment 38 during practice or actual play. In this regard, it is preferred that the material of the cover portion 14 is the same stretchable fabric used for the compression garment 12. However, the material of the cover portion 14 can be a stretchable fabric having a greater or lesser elasticity than that of the compression garment 12.

When extended downward and over the protective equipment 38, it is preferred that the free ends 32 of the cover portions 14 are positioned below the lowermost portion of the protective equipment 38. To assist in retaining the cover portions 14 in this extended position, the free end 32 may be provided with a suitable elastic band, one that would have sufficient elasticity to allow the free end 32 to be positioned at the mid-thigh of the wearer while protective equipment 38 is being put on, but that would elastically contract so as to retain the free end 32 of the cover portions 14 below the protective equipment 38 during practice or play.

The compression garment 12 may additionally include an integrally formed cup pocket 40 on the interior of the torso section 16. The cup pocket 40 may be formed by securing a last of material generally in the middle front of the torso section 16, between the leg sections 18. The cup pocket 40 allows for the insertion of an athletic cup (not shown) into the cup pocket such that the athletic cup is retained and properly positioned to protect a male wearer of the athletic pants 10.

Figure 3:
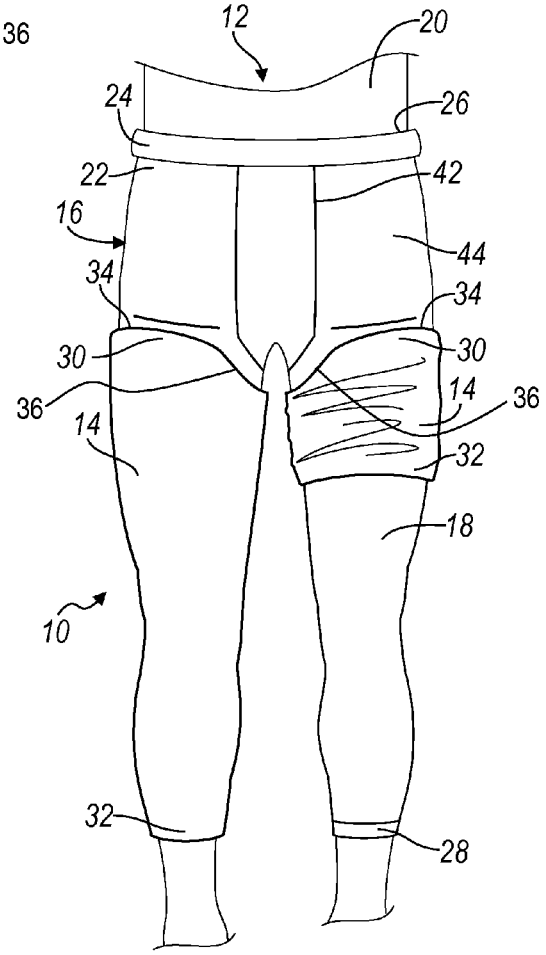
FIG. 3 is a posterior view of the athletic pants seen in FIGS. 1 and 2.

The compression garment 12 may additionally include features to define an integrally formed athletic supporter with the torso section 16. Such features may include seams or straps 42 extending rearward from the lower portion of the cup pocket 40. As seen in FIG. 3, the seams 42 extend upward over a rear portion 44 of the torso section 16 and terminate at the band 24. The seams 42, which are continuations of the lateral seams 46 used to secure the last in forming the cup pocket, limit the amount of stretch provided in the area of the cup pocket 40 and, as a result, increase the amount of support provided by the cup pocket 40, either with or with a cup protector provided therein.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

I claim:

1. Athletic pants comprising:

a body portion configured to be worn about at least part of the lower torso and legs of a person's body, the body portion including a torso section and a pair of leg sections, each of the leg sections having an upper end integrally formed with and extending downward from the torso section to a lower end of the leg section; and a pair of sock portions, each sock portion extending over a majority of one of the leg sections, from the upper end of the leg section toward the lower end, the sock portions being non-removably attached to the leg sections adjacent to the upper ends by a first end of the sock portions, a second end of the sock portions being unattached to the body portion, whereby the second end of the sock portion is moveable relative to the leg section to position the sock portion relative to the leg portion.

2. The athletic pants of claim 1, wherein the sock portions form a sleeve about the leg sections.

3. The athletic pants of claim 1, wherein the sock portions are located exteriorly of the leg sections.

4. The athletic pants of claim 1, wherein the sock portion is free and unconnected to the body portion other than at the first end.

5. The athletic pants of claim 1, wherein the sock portion is only attached to the leg portion at the first end.

6. The athletic pants of claim 1, further comprising a protective pocket located within the torso portion.

7. The athletic pants of claim 6, wherein the protective pocket is generally located between the leg portions.

8. Athletic pants comprising:

a body portion configured to be worn about at least part of the lower torso and legs of a person's body, the body portion including a torso section and a pair of leg sections, the leg sections having an upper end integrally formed with and extending downward from the torso section, the leg sections further including a lower end; and a pair of sock portions, each sock portion extending over at least part of one of the leg sections, the sock portions being non-removably attached to the body portion at a first end of the sock portions, a second end of the sock portions being unattached to the body portion, whereby the second end of the sock portion is moveable relative to the leg section to position the sock portion relative to the leg portion, the leg sections including a lateral side and a medial side, the first end of the sock portion having an offset at the medial side relative to a remainder of the first end of the sock portion.

9. The athletic pants of claim 8, wherein the portion of the first end defining the offset is offset in a direction toward the second end.

10. The athletic pants of claim 9, wherein the offset defines a generally U-shaped configuration in the first end of the sock portion.

11. Athletic pants comprising:

a body portion configured to be worn about at least part of the lower torso and legs of a person's body, the body portion including a torso section and a pair of leg sections, each of the leg sections having an upper end. integrally formed with and extending downward from the torso section to a lower end of the leg section; and a pair of sock portions, each sock portion extending over one of the leg sections, the sock portion is attached to the leg section only in a region of the leg sections generally adjacent to the torso section of the body portion, the sock portions being non-removably attached to the leg sections adjacent to the upper ends by a first end of the sock portions, the lower ends of the leg section being unattached to the sock portions, whereby the second ends of the sock portions are movable relative to the leg section to position the sock portion relative to the leg portion.

12. Athletic pants comprising:

a compression garment made of a stretchable fabric configured to substantially conform to the contours of a person wearing the compression garment, the compression garment including a hollow torso section, the torso section having at its upper end a portion defining an opening and having at its lower end portions defining a pair of hollow legs extending in a direction away from the opening and terminating foot openings through which the person's foot may be extended; and cover portions disposed over and surrounding at least a portion of each leg, each of the cover portions having attached and free ends, the cover portions being attached at their attached ends directly to the legs of the compression garment and otherwise being unattached to the compression garment such that the free ends of the cover portions are selectively positionable respectively along the length of the leg over which the cover portion is disposed.

13. The athletic pants of claim 12, wherein the cover portion is formed of a stretchable fabric.

14. The athletic pants of claim 13, wherein the stretchable fabric of the cover portion is the same as the stretchable fabric of the compression garment.

15. The athletic pants of claim 12, wherein the free ends of the cover portions terminate in elastic portions constricting openings defined by the free ends.

16. The athletic pants of claim 12, wherein the opening at the upper end of the torso section is a waist opening.

17. Athletic pants comprising:

a compression garment made of a stretchable fabric configured to substantially conform to the contours of a person wearing the compression garment the compression garment including a hollow torso section, the torso section having at its upper end a portion defining an opening and having at its lower end portions defining a pair of hollow legs extending in a direction away from the opening and terminating foot openings through which the person's foot may be extended; and cover portions disposed over and surrounding at least a portion of each leg each of the cover portions having attached and free ends, the cover portions being attached at their attached ends to the compression garment and otherwise being unattached to the compression garment such that the free ends of the cover portions are selectively positionable respectively along the length of the leg over which the cover portion is disposed, each of the legs including a lateral side and a medial side, the first ends of the cover portions being attached to the compression garment so as to define an offset located generally on the medial side of the legs.

18. The athletic pants of claim 17, wherein the offsets extends in a direction toward the foot openings of the legs.

19. The athletic pants of claim 18, wherein the offsets are formed by seams attaching the cover portions to the compression garment, the seams of the offsets being located a distance to the free ends of the cover portion that is less than a distance from other portions of the seam to the fee ends of the cover portion.

20. The athletic pants of claim 18, wherein the offsets are formed by seams attaching the cover portions to the compression garment, the seams of the offsets forming a generally U-shaped loop extending in a direction toward the free ends of the cover portions.

21. Athletic pants comprising:

a compression garment made of a stretchable fabric configured to substantially conform to the contours of a person wearing the compression garment, the compression garment including a hollow torso section, the torso section having at its upper end a portion defining, an opening and having at its lower end portions defining a pair of hollow legs extending in a direction away from the opening and terminating foot openings through which the person's foot may be extended; and cover portions disposed over and surrounding at least a portion of each leg. each of the cover portions having attached and free ends, the cover portions being attached at their attached ends to the compression garment and otherwise being unattached to the compression garment such that the free ends of the cover portions are selectively positionable respectively along the length of the leg over which the cover portion is disposed, and a protective pocket formed within the torso section, the protective pocket being centrally located on the torso section generally between the legs.

* * * * *